US008896198B2

(12) United States Patent
Falicoff et al.

(10) Patent No.: US 8,896,198 B2
(45) Date of Patent: Nov. 25, 2014

(54) LED LIGHT BULB WITH TRANSLUCENT SPHERICAL DIFFUSER AND REMOTE PHOSPHOR THEREUPON

(75) Inventors: Waqidi Falicoff, Stevenson Ranch, CA (US); Yupin Sun, Yorba Linda, CA (US); Will Shatford, Pasadena, CA (US)

(73) Assignee: Light Prescriptions Innovators, LLC, Altadena, CA (US)

( * ) Notice: Subject to any disclaimer, the term of this patent is extended or adjusted under 35 U.S.C. 154(b) by 0 days.

(21) Appl. No.: 13/696,948

(22) PCT Filed: May 19, 2011

(86) PCT No.: PCT/US2011/037085

§ 371 (c)(1), (2), (4) Date: Nov. 8, 2012

(87) PCT Pub. No.: WO2011/146677

PCT Pub. Date: Nov. 24, 2011

(65) Prior Publication Data

US 2013/0057140 A1 Mar. 7, 2013

Related U.S. Application Data

(60) Provisional application No. 61/346,728, filed on May 20, 2010.

(51) Int. Cl.

| | |
|---|---|
| ***H01J 1/62*** | (2006.01) |
| ***H01J 63/04*** | (2006.01) |
| ***F21K 99/00*** | (2010.01) |
| ***F21V 5/04*** | (2006.01) |
| *F21Y 111/00* | (2006.01) |
| *F21Y 101/02* | (2006.01) |

(52) U.S. Cl.

CPC . *F21K 9/135* (2013.01); *F21K 9/54* (2013.01); *F21V 5/041* (2013.01); *F21Y 2111/002* (2013.01); *F21K 9/56* (2013.01); *F21Y 2101/02* (2013.01)

USPC ..... 313/501; 313/502; 362/241; 362/247; 362/296.01; 362/297

(58) Field of Classification Search

USPC ..... 313/498–512; 362/609, 560, 514, 516, 362/217.05, 241, 247, 296.01, 297, 327, 362/341

See application file for complete search history.

(56) References Cited

U.S. PATENT DOCUMENTS

| | | | | |
|---|---|---|---|---|
| 3,821,590 | A * | 6/1974 | Boivin et al. | 313/499 |
| 7,686,478 | B1 * | 3/2010 | Hulse et al. | 362/255 |
| 7,887,225 | B2 * | 2/2011 | Lee et al. | 362/561 |
| 8,109,656 | B1 * | 2/2012 | Hulse | 362/293 |
| 2007/0267976 | A1 | 11/2007 | Bohler et al. | |
| 2009/0251882 | A1 | 10/2009 | Ratcliffe | |
| 2009/0273918 | A1 | 11/2009 | Falicoff et al. | |
| 2010/0134047 | A1 * | 6/2010 | Hasnain | 315/302 |

(Continued)

*Primary Examiner* — Nimeshkumar Patel
*Assistant Examiner* — Jose M Diaz
(74) *Attorney, Agent, or Firm* — Drinker Biddle & Reath LLP

(57) ABSTRACT

An LED lamp is disclosed comprising a remote phosphor patch on or near the interior surface of a translucent sphere. The phosphor is illuminated by an adjacent light box containing blue LEDs, located within the lamp below the transmissive phosphor patch or alternatively above a reflective phosphor patch. The reflective patch can be either fully or partially populated with phosphor. Below the light box is an electronics bay, and below that is an Edison screw-in base.

13 Claims, 6 Drawing Sheets

(56) References Cited

U.S. PATENT DOCUMENTS

2011/0006668 A1* 1/2011 Hussell et al. ..... 313/499
2011/0175117 A1* 7/2011 Jagt et al. ..... 257/88
2011/0235339 A1* 9/2011 Shyu et al. ..... 362/326
2011/0260192 A1* 10/2011 Kwak et al. ..... 257/98
2012/0188771 A1* 7/2012 Kraus et al. ..... 362/294

* cited by examiner

LED LIGHT BULB WITH TRANSLUCENT SPHERICAL DIFFUSER AND REMOTE PHOSPHOR THEREUPON

CROSS REFERENCE TO RELATED APPLICATIONS

This application claims the benefit of U.S. Provisional Application No. 61/346,728, filed May 20, 2010, the entire disclosure of which is incorporated herein by reference.

BACKGROUND OF THE INVENTION

LED light bulbs are challenging for both optical design and heat transfer. The wide angle hemispheric output of an LED, with its cosine falloff, must be transformed into a fully spherical pattern. Various patents of the prior art disclose methods of producing the desired pattern, but heat transfer and efficiency remain key issues. Often the optimal shape for a particular design will substantially depart from the overall look and shape of a typical light bulb. Thus there is a need for a light bulb with nearly the same shape and diffuse appearance as incandescent light bulbs.

SUMMARY OF THE INVENTION

An important aspect of the interior geometry of the sphere is invariance of illuminance of the surface of the sphere from a Lambertian source on the surface of the sphere, facing its center. Not only does source intensity have its own inherent cosine falloff, but there is another foreshortening when the receiving surface is slanted relative to the light rays as well. On the inside of a sphere, however, these two angles are always equal, and the greater the slant angle of the source the closer is the equally slanted receiver, also proportionally to the cosine of the slant angle. The two $\cos^2$ terms cancel out. Thus all portions of the sphere are equally illuminated by a Lambertian source on its interior surface. When the spherical surface is that of an ideal translucent globe, its diffuse transmittance will erase the original direction of the light, resulting in a uniform glow emanating from the surface. The frosted envelope of many incandescent light bulbs still shows the filament somewhat, proving that less than perfect diffusion by the translucent globe, and a somewhat inhomogeneous look, are acceptable for many practical implementations. Traditionally, uniformity back to 150° from forward has been the definition of spherical emission, with further angles typically blocked by the neck of the bulb.

When illuminating a translucent sphere from its surface, however, the diffusion must be total in order for the globe to emanate spherically. That is, incoming light at any slant is scattered into the same Lambertian pattern, its original direction erased. Moreover, actual translucent diffusers exhibit reflective as well as transmissive scattering, so that they reflect more light back into the sphere than would the small Fresnel reflection by a transparent globe. This backscattering helps further homogenize the sphere's interior illuminance.

These fundamental principles are also taught in co-pending U.S. Provisional Applications by several of the same inventors, 61/333,929, titled "Solid-State Light Bulb with Interior volume for Electronics", filed May 12, 2010, 61/299,601 of the same title filed Jan. 29, 2010, and 61/280,856 of the same title, filed on Nov. 10, 2009, all three of which are incorporated herein by reference in their entirety. In these co-pending applications there is a remote phosphor sphere which is illuminated by blue and other color LEDs, where the LEDs are situated on or near the base of the spherically shaped phosphor. In that family of applications, the Lambertian emitting LEDs uniformly illuminate the inner surface of a spherically-shaped phosphor layer, which can be either hollow or on the outside of a solid dielectric. The present application differs from the earlier aforementioned applications in that the phosphor layer is located below a spherical or tailored shape diffuser. Further, the LEDs are located in a separate mixing chamber remote from the phosphor layer, similar to the approach taught in co-pending U.S. Utility Ser. No. 12/587,246, by several of the same inventors, filed Oct. 5, 2009, published May 6, 2010 as US 2010-0110676 A, and titled "Compact LED Downlight with Cuspated Flux-Redistribution lens", which is incorporated herein by reference in its entirety.

Two architectures are provided in the present application for the remote phosphor. The first has the remote phosphor operate in its so-called transmittance mode, while the second operates the phosphor in its so-called reflection mode. The two modes of operation are taught in several US patents including: U.S. Pat. No. 7,286,296 and U.S. Pat. No. 7,380,962 both titled "Optical Manifold for Light-Emitting Diodes", by several of the same inventors. Both these patents are incorporated herein by reference in their entirety. The present lamps also make use of the reflective remote phosphor principle taught in a co-pending application, also by several of the same inventors, U.S. application Ser. No. 12/387,341, filed on May 1, 2009, published Nov. 5, 2009 as US 2009-0273918A, titled "Remote Phosphor LED Downlight", which is incorporated herein by reference in its entirety. Light sources described in that application use a reflection mode remote phosphor where a phosphor pattern is deposited on top of a highly diffusive reflective material (typically white in color). The ratio of the phosphor area compared to the uncoated area determines the color temperature of the light output.

Conventional white LEDs comprise a phosphor coating covering a blue-emitting chip or chips. In contrast, a remote-phosphor white light source has a phosphor patch illuminated by a separate source of blue light. Optionally, there can be additional color light sources such as red ones, which mix with the yellowish or greenish output of the phosphor and the unconverted part of the blue light. Because a phosphor's heat load is about 30% of its radiant output (the so-called Stokes shift loss), it is advantageous for blue LED chips when they are remote from the phosphor and do not bear this additional heat load. Also, a remote phosphor is more uniform in brightness and color than an array of conventional white LEDs, because the array will have dark spaces between the chips.

BRIEF DESCRIPTION OF THE DRAWINGS

The above and other aspects, features and advantages of the present invention will be apparent from the following more particular description thereof, presented in conjunction with the following drawings wherein.

DETAILED DESCRIPTION OF THE PREFERRED EMBODIMENTS

A better understanding of various features and advantages of the present invention will be obtained by reference to the following detailed description of the invention and accompanying drawings, which set forth illustrative embodiments in which certain principles of the invention are utilized.

One core idea of the present embodiments of lamps is the deployment of a transmissive phosphor patch on the interior of a translucent sphere. Total scattering by the sphere's surface leads to the surface having a uniform glow when externally viewed. Even in a practical embodiment, such a sphere can be more luminously uniform than most conventional frosted light bulbs. The various embodiments of the present specification differ in the arrangement for the illumination of the phosphor patch with blue light. A second core idea is exemplified in an embodiment where phosphor patch is located below the entrance aperture of the translucent sphere and operates in the reflection mode. In this embodiment the entrance aperture is either open or has a diffusing optical element which helps to mix the light from the phosphor with remaining blue light and light from other color LEDs. In both cases the Lambertian output from this entrance aperture uniformly illuminates the translucent sphere.

Figure 1:
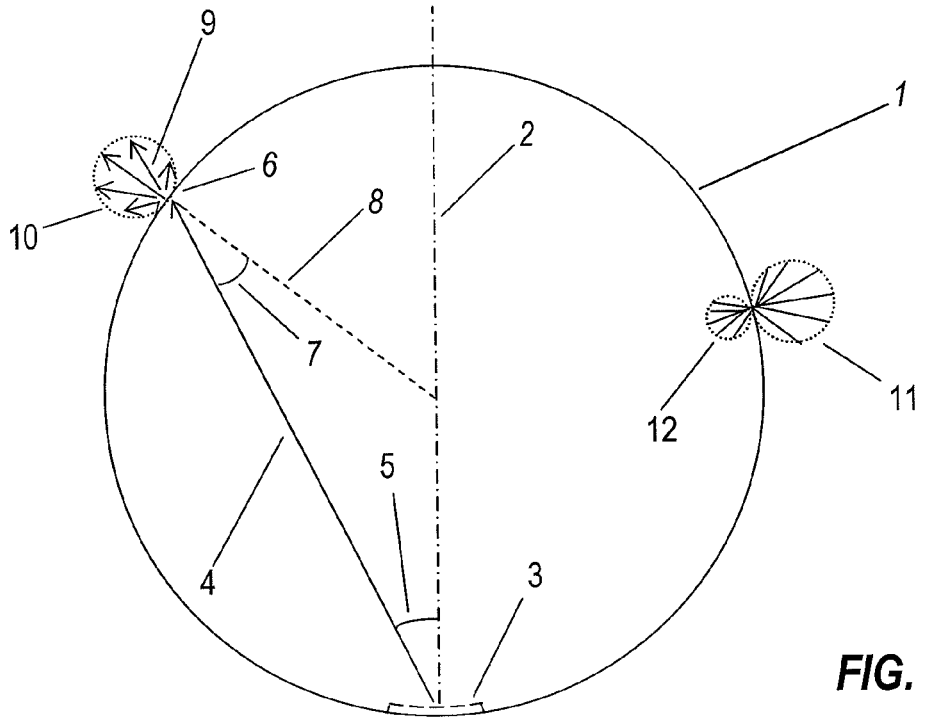
FIG. 1 shows a transmissive remote phosphor on the surface of a sphere and shining into its interior.

FIG. 1 shows a cross-sectional view of a translucent sphere 1. Centerline 2 goes through a small phosphor patch 3, which emits exemplary ray 4 at angle 5 from the surface normal as defined by centerline 2. Ray 4 intersects the sphere interior at point 6, at local incidence angle 7 with local radius 8. Incidence angle 7 necessarily equals angle 5, a value in degrees hereinafter designated $\theta$. Ray 4 is scattered by the sphere surface at point 6 into diffusely transmitted light 9 that has the same Lambertian pattern, designated by dotted circle 10, no matter from what angle the surface is illuminated. This is the definition of complete optical diffusion: the erasure of incoming directional information.

For sphere radius R, diameter D=2R, and incidence angle $\theta$, the length of ray 4 is $r=D/\cos\theta$. If phosphor patch 3 has area A and radiates light with luminosity L, then its on-axis intensity is $I_0=L/\pi A$. At off-axis angle $\theta$ the intensity is $I=I_0=\cos\theta$. At point 6 the intensity of the light is given by $I\cos\theta/r^2$. Because of the local incidence angle 7, the illuminance $i=I\cos^2\theta/r^2=I_0/D^2$, which is independent of $\theta$ and hence of the location of point 6. This is the principle used by all integrating spheres to assure a homogeneous and isotropic light field within. This principle also assures that a translucent sphere illuminated from a Lambertian source anywhere on its interior surface will have a uniform brightness. Dotted circle 11 of FIG. 1 denotes the Lambertian emission of transmitted light as being the same as for that of circle 10, but there is also smaller dotted circle 12, not shown for the sake of clarity with circle 10, denoting the Lambertian emission of diffusely reflected light. While a smooth surface, such as that of a holographic diffuser, specularly reflects only a few percent, the typical surface diffuser also reflects some greater amount than this, but not specularly. This backscattering further homogenizes the light field within the sphere.

The calculation illustrated by FIG. 1 is for any point Lambertian source within phosphor patch 3, and can of course be integrated over a phosphor patch 3 of finite size.

Figure 2:
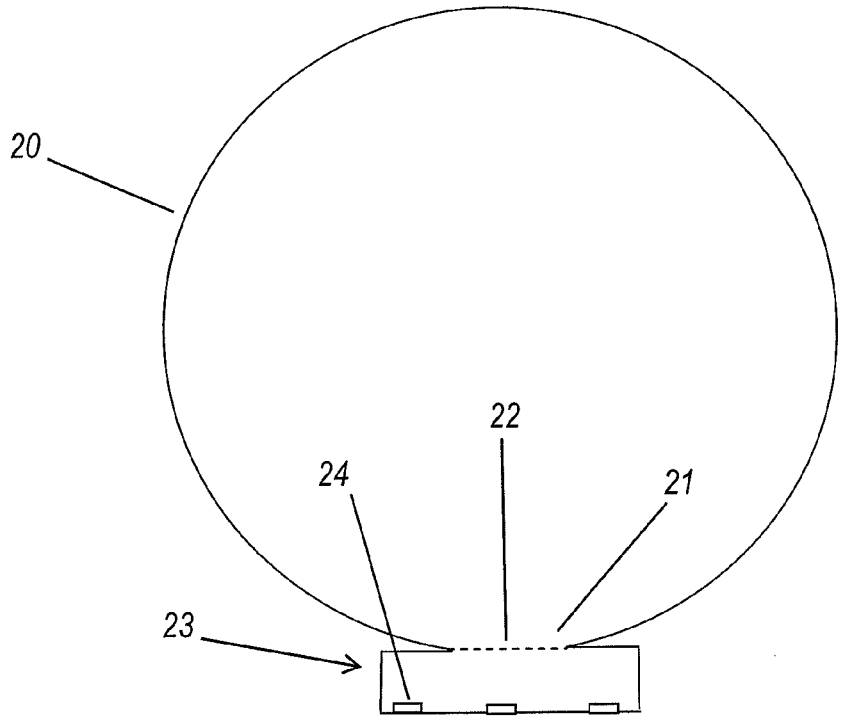
FIG. 2 shows a similar sphere with a light box outside the sphere coupled to the remote phosphor.

Having established the utility of a phosphor patch installed on the inside surface of a translucent sphere, there remains establishing how the phosphor will be illuminated with blue light. FIG. 2 shows sphere 20 with aperture 21 covered by transparent phosphor patch 22, one side of which illuminates the interior of mixing box 23, all the interior surfaces of which are diffusely reflecting. Mixing box 23 is illuminated by blue LEDs 24, homogenizing their illumination of phosphor patch 22 just above them. Box 23 also recycles the backscattered phosphor emission, so the high reflectance of its interior surface is paramount, because of the multiple reflections undergone by rays inside it. The phosphor patch shines into the interior of sphere 20, to be diffused as exemplified by ray 4 of FIG. 1.

Figure 3:
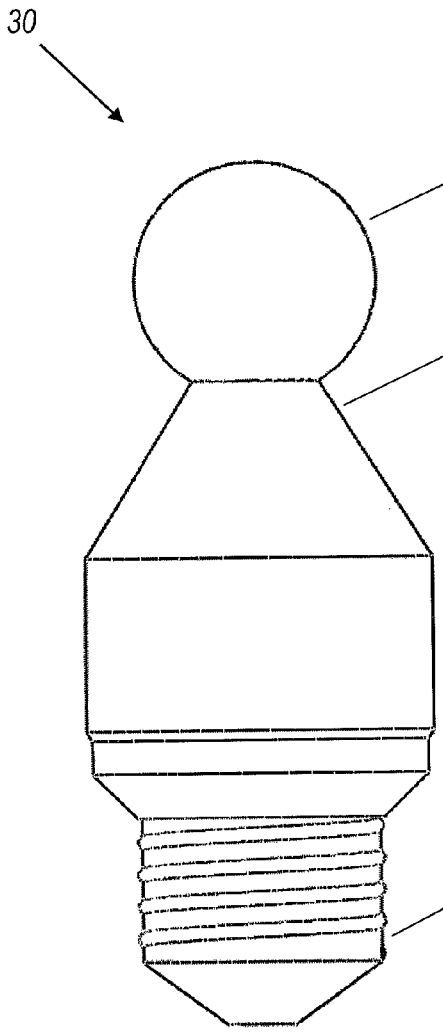
FIG. 3 is a lateral view of a light bulb built around the box of FIG. 2.

The embodiment of FIG. 1 and FIG. 2 is only part of a complete light bulb. FIG. 3 is a lateral view of light bulb 30, comprising translucent light-emitting sphere 31, main body 32, and Edison screw-in base 33.

Figure 4:
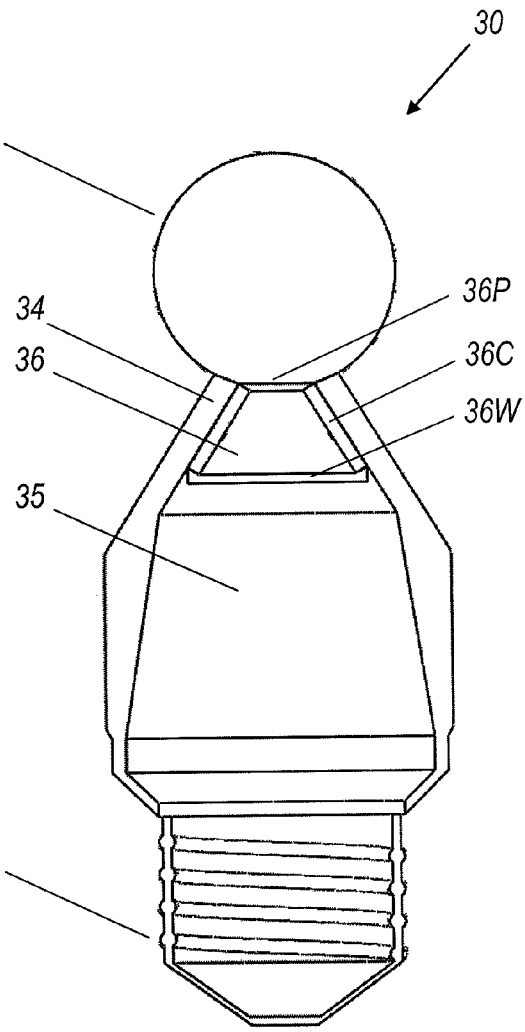
FIG. 4 is a cutaway view of the light bulb of FIG. 3.
Figure 5:
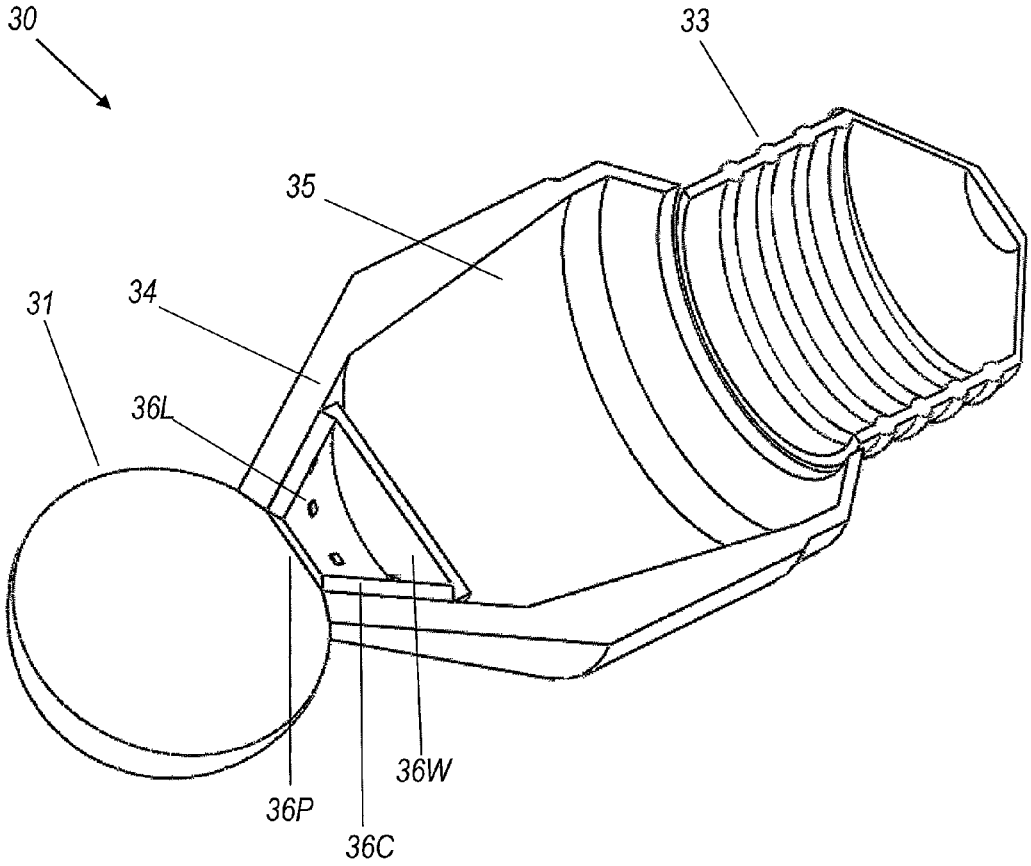
FIG. 5 is a cutaway perspective view of the light bulb of FIG. 3.

FIG. 4 is a lateral cutaway view of the same light bulb 30, also showing heat-conducting sidewall 34 enclosing electronics bay 35 and mixing chamber 36. Mixing chamber 36 is in the shape of a cone frustum, which is enclosed by LED circuit boards 36C forming the conical surface, reflecting wall 36W forming the base, and remote phosphor 36P forming the narrow end. Remote phosphor sheet 36P forms the interface between mixing chamber 36 and sphere 31. FIG. 5 is a perspective cutaway view of the same light bulb 30, also showing the blue LEDs 36L disposed around the conical circuit board 36C. Although the LEDs 24 can be positioned on the base of light box 23 facing phosphor 22, as shown in FIG. 2, positioning the LEDs on the side wall 36C improves heat management, because the heat from the LEDs can then be transferred directly to the heat sink 34. Also, positioning the LEDs 36L on a downwardly facing surface such as conical surface conical surface 36C, so that most of their light is reflected from surface 36W before reaching phosphor 36P, can improve the uniformity of the illumination of phosphor 36P enough to compensate for the small loss of light intensity through absorption at the reflective surface 36W.

Figure 6:
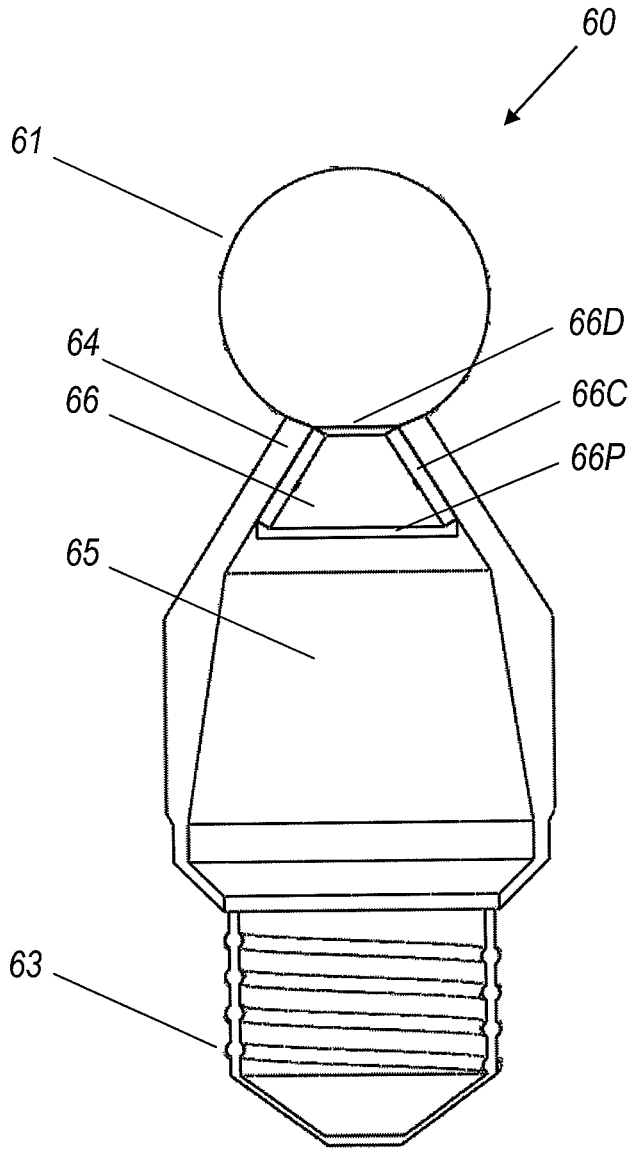
FIG. 6 is a cutaway view of an alternative embodiment of the light bulb, similar to that of FIG. 3, with a reflective phosphor.
Figure 7:
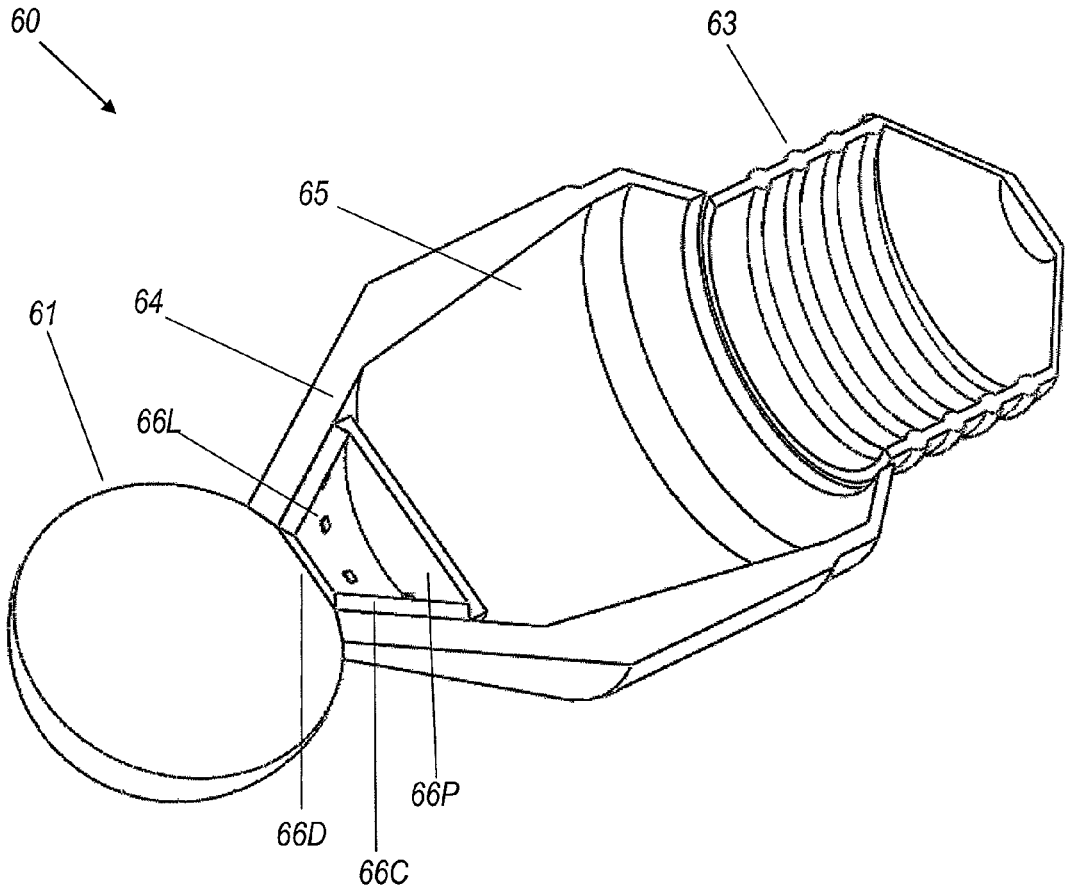
FIG. 7 is a cutaway view of the light bulb of FIG. 6.

The phosphor sheet 36P in FIG. 4 and FIG. 5 operates in transmission mode. Referring to light bulb 60 shown in FIGS. 6 and 7, one could also have the phosphor sheet operate in the reflection mode. The arrangement is generally similar to that shown in FIG. 4 and FIG. 5, but the base wall of mixing chamber 66 is formed by a phosphor sheet 66P with a reflective substrate (preferably having diffuse reflective properties) which also conducts heat away from the phosphor to the conducting sidewall 34. Interface 36P is a diffusive transmissive sheet 66D, such as a holographic diffuser, which mixes direct light from the LEDs 66L on conical circuit board 66C with down-converted light from the phosphor 66P and light from the LEDs scattered but not converted by the phosphor. Diffusive sphere 61, Edison screw 63, heat sink 64, and electronics bay 65 shown in FIGS. 6 and 7 are generally similar to the corresponding features of FIGS. 3 to 5.

Figure 8:
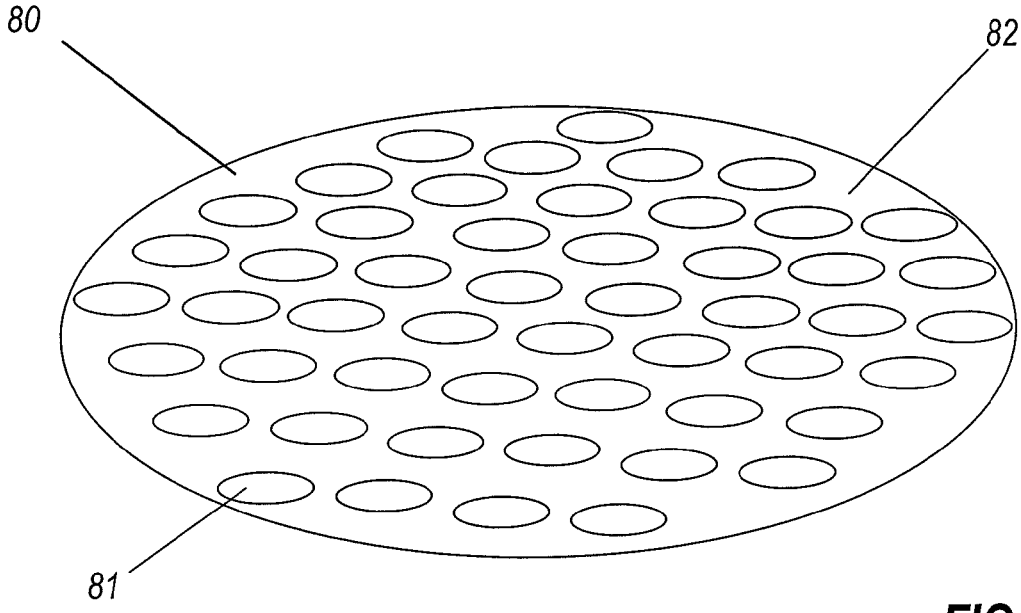
FIG. 8 is a perspective view of a partially populated reflective mode remote phosphor.

FIG. 8 shows an embodiment of a phosphor patch 80 where the reflective remote phosphor 81 is partially populated on a diffuse reflective base 82 as taught in above-mentioned U.S. Ser. No. 12/387,341. The thickness of remote phosphor only need be above a certain level for complete conversion of blue light striking it. By selecting the proportion of the area of base 80 that is covered by remote phosphor 81, the proportion of blue light that is down-converted by the phosphor, and therefore the color-temperature of the resulting mixed light exiting the mixing box, is then determined by the ratio of area covered by phosphor patches to that not covered. If the thickness of remote phosphor 81 is below the level required for complete conversion, then the ratio of areas is adjusted accordingly.

It is possible to extend the illumination capability of the light bulb by also installing non-blue LEDs along with the phosphor-stimulating blue ones. In particular, red LEDs can be used to supplement or replace the long-wavelengths of the phosphor, allowing the light bulb to control color temperature independently. A typical system with equivalent output to a 60 W incandescent lamp consists of six currently available 1 mm×1 mm, 450 nm blue LED chips, with efficiency of 40% and driven at 350 mA, and three 630 nm, 1 mm×1 mm, red LED chips with efficiency of 30% and driven at 350 mA together with a greenish-yellow phosphor from Phosphortech, BUVY03, or Intematix, Y4254, yielding a CRI of 88 and a CCT 2900K. For phosphor particle sizes of approximately 15 microns, the phosphor surface density that would give the above performance values is approximately 8-10 $mg/cm^2$.

In order to achieve the highest efficacy and CRI, LEDs of other wavelengths, such as 505 nm cyan, can be added that when combined with light from the yellow or green phosphor, as well as from blue and red LEDs, gives broad band light with no dips, and little power beyond 700 nm, in the spectrum. CRI of well over 90 and lamp efficacy of 80 lm/W can be achieved with a CCT of 2900K using currently available LED chips and phosphors.

The present embodiments can make use of the driver and dimming systems taught in U.S. patent application Ser. No. 12/589,071, filed 16 Oct. 2010 and published as US 2010-0097002 A on Apr. 22, 2010 titled "Quantum Dimming Via Sequential Stepped Modulation of LED Arrays" by several of the same Inventors, which is incorporated herein by reference in its entirety.

The preferred ratio of the number of blue chips to red chips is an integer. For example, there can be 4 blue chips and 4 red chips or there can be 6 blue chips and 3 red chips. This preferred integer ratio makes it easier to dim the lamp using the quantum dimming approach. In the case where there are 4 blue and 4 red LEDs, there are four levels of output (25%, 50%, 75% and 100%), while in the case with 6 blue and 3 red then three levels can be obtained. This is possible without using pulse width modulation for either the blue or red sources. In the case where there is a non-integer ratio between the numbers of blue and red LEDs, the number of quantum dimming levels may be limited to the highest common factor of the numbers. Where a greater number of dimming levels is desired, then the system still can work but one or more of the LEDs may require pulse width modulation.

Although distinct embodiments have been described and shown in the several drawings, features from the different embodiments may be combined in a single embodiment.

Although the diffusive component 31, 61 has been described as a sphere, and has been assumed to be perfectly diffusive, it will be apparent from comparison with conventional incandescent bulbs that some departure from a perfectly spherical shape, and some departure from perfect diffusion, may be accepted in practice. The degree of departure that is acceptable may be determined by the degree of departure from perfectly uniform appearance and/or perfectly uniform far field illumination that is acceptable for a given use or to comply with a given standard or specification.

Although the light sources 36L, 66L have been described as "LEDs," the teachings of the present specification may be applied to other sources of light, including sources that may be developed in the future.

Although the phosphor patch 36P or diffuser 66D has been described as being on or forming part of the surface of the sphere, it will be understood that various configurations are practical. For example, the sphere 31, 61 may be hollow, with the phosphor patch 36P or diffuser 66D applied to its inside or outside surface. For example, the sphere 31, 61 may be solid, with the phosphor patch 36P or diffuser 66D applied to its outside surface. For example, the phosphor patch 36P or the diffuser 66D may be, or may be mounted on, a separate component that is attached to or inset into the sphere 31, 61. The phosphor patch 36P or the diffuser 66D may be curved to follow the shape of the sphere, flat, or another expedient shape.

The preceding description of the presently contemplated best mode of practicing the invention is not to be taken in a limiting sense, but is made merely for the purpose of describing the general principles of the invention. The full scope of the invention should be determined with reference to the Claims.

We claim:

1. A remote-phosphor lamp comprising:
- a round, translucent diffuser; and
- a light engine that in operation emits light into the interior of the diffuser through an exit aperture occupying a minor portion of the round surface of the diffuser;
- wherein the light engine comprises:
  - a light mixing box on the outside of the diffuser, wherein the exit aperture is an exit for light from the light box;
  - a phosphor patch; and
  - a source of light within the light mixing box that in operation illuminates and excites the phosphor; and
  - wherein the exit aperture is an exit for light from the light box and is smaller than a surface of the light mixing box opposite the exit aperture.

2. The lamp of claim 1, wherein the exit aperture is formed by a diffusive component.

3. The lamp of claim 2, wherein the diffusive component is the phosphor patch.

4. The lamp of claim 1, wherein the phosphor patch is within the light mixing box on said surface opposite the exit aperture and faces the exit aperture and the light source is within the light mixing box on a surface of the light mixing box facing the phosphor patch.

5. The lamp of claim 1, wherein the light mixing box is in the shape of a cone frustum, the exit aperture forms the small end of the cone frustum, the light source is on the conical surface of the cone frustum, and a reflective surface forms the large end of the cone frustum.

6. The lamp of claim 1 wherein the light source comprises one or more blue emitters.

7. The lamp of claim 6, wherein the light source further comprises one or more red emitters, and the phosphor down-converts part of the blue light from the blue emitters to green or yellow light.

8. The lamp of claim 1, wherein the diffuser is hollow, with the phosphor patch on its interior surface covering the exit aperture, said phosphor patch illuminated with blue light.

9. The lamp of claim 8, wherein said blue light is provided by said light mixing box containing blue LEDs, said light mixing box with diffusely reflecting interior walls of high reflectance.

10. The lamp of claim 9, wherein said light box has a heat pipe attached to said one or more LEDs.

11. The lamp of claim 9, wherein said light mixing box also comprises LEDs emitting colors other than blue.

12. A remote-phosphor LED lamp comprising a translucent spherical diffuser with a phosphor patch, said phosphor patch illuminated with blue light, wherein said blue light is provided by a light mixing box containing blue LEDs, said light mixing box with diffusely reflecting interior walls of high reflectance, said light mixing box with an exit aperture smaller than a surface of the light mixing box opposite the exit aperture, wherein said phosphor patch is on an interior side wall of the said light mixing box which is coupled to a transmissive diffusing surface of the said translucent spherical diffuser.

13. A remote-phosphor lamp comprising:

a round, translucent diffuser; and a light engine that in operation emits light into the interior of the diffuser through an exit aperture occupying a minor portion of the round surface of the diffuser;

wherein the light engine comprises:

a phosphor patch; and a source of light that in operation illuminates and excites the phosphor;

wherein the light engine comprises a light box on the outside of the diffuser, wherein the light source is within the light box and the exit aperture is an exit for light from the light box; and wherein the light box is in the shape of a cone frustum, the exit aperture forms the small end of the cone frustum, the light source is on the conical surface of the cone frustum, and a reflective surface forms the large end of the cone frustum.

* * * * *